US007575439B2

(12) United States Patent
Chen et al.

(10) Patent No.: US 7,575,439 B2
(45) Date of Patent: Aug. 18, 2009

(54) SPEAKER CONNECTOR

(75) Inventors: Ming-chiang Chen, Tu-Cheng (TW); Ping-chih Chen, Tu-Cheng (TW); Feng-xiang Li, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/987,595

(22) Filed: Dec. 3, 2007

(65) Prior Publication Data

US 2009/0142961 A1 Jun. 4, 2009

(51) Int. Cl.
*H01R 13/502* (2006.01)

(52) U.S. Cl. ..... 439/66; 439/700

(58) Field of Classification Search ..... 439/66, 439/700, 824, 862

See application file for complete search history.

(56) References Cited

U.S. PATENT DOCUMENTS

| | | | | |
|---|---|---|---|---|
| 6,783,370 | B2 * | 8/2004 | Miyamoto et al. | 439/66 |
| 6,814,623 | B2 * | 11/2004 | Hashiba | 439/660 |
| 7,048,549 | B1 * | 5/2006 | Swain | 439/66 |
| 7,074,048 | B2 * | 7/2006 | Liao et al. | 439/66 |
| 7,150,632 | B2 * | 12/2006 | Lee et al. | 439/66 |
| 7,226,293 | B2 * | 6/2007 | Na et al. | 439/66 |
| 7,270,550 | B1 * | 9/2007 | Peng | 439/66 |
| 7,275,936 | B1 * | 10/2007 | Ju | 439/66 |
| 7,322,831 | B1 * | 1/2008 | Peng | 439/66 |
| 7,445,518 | B2 * | 11/2008 | Schneider nee Hild et al. | 439/700 |
| 7,455,556 | B2 * | 11/2008 | Mendenhall et al. | 439/862 |
| 2005/0064766 | A1 * | 3/2005 | Zhang et al. | 439/700 |
| 2007/0093145 | A1 * | 4/2007 | Wei | 439/824 |

* cited by examiner

*Primary Examiner*—Gary F. Paumen
(74) *Attorney, Agent, or Firm*—Rosenberg, Klein & Lee

(57) ABSTRACT

A speaker connector for connecting a speaker and a printed circuit board of an electronic device includes an insulating housing and a terminal. The insulating housing defines a holding groove extending therethrough. The terminal has a retaining portion retained in the holding groove of the insulating housing. A first resilient portion is connected to an upper end of the retaining portion and extends out of the holding groove. A first contact portion extends sideward from the first resilient portion for connecting the speaker. A second resilient portion with a zigzag configuration is connected to a lower end of the retaining portion and contained in the holding groove. A second contact portion is connected to a lower end of the second resilient portion and extends out of the holding groove for elastically touching the printed circuit board.

4 Claims, 3 Drawing Sheets

SPEAKER CONNECTOR

BACKGROUND OF THE INVENTION

1. Field of the Invention

The present invention relates to a speaker connector, and more particularly to a speaker connector used in a mobile electronic device, such as a mobile phone, a PDA, etc. for connecting a speaker with a printed circuit board (PCB) of the mobile electronic device.

2. The Related Art

As the rapid development of electronic technology, electronic devices like mobile phones become more compact. A speaker connector as a conventional element used in the electronic device is designed compactly and has a good electric property according with the compact electronic device. The speaker connector is used for connecting a speaker with a printed circuit board (PCB) of the electronic device. The speaker connector generally includes an insulating housing and a pair of terminals received in the insulating housing respectively. The terminal has a soldering portion soldered on the PCB of the electronic device and a contact portion pressed against a contact of the speaker for realizing an electrical connection between the speaker and the PCB.

However, the terminals of the speaker connector are liable to become loose, or what is badly, unsoldering from the PCB of the electronic device when the speaker connector suffers collisions, which causes the communication between the speaker and the PCB to be broken off. Besides, if the electronic device needs to change another speaker connector, because the terminals of the speaker connector are soldered on the PCB, the difficulty of disassembling the speaker connector apart from the PCB is increased, and even more, the PCB and the speaker connector are easily damaged in the process of disassembly, which brings a bad influence on the audio quality of the electronic device. Then because the PCB and the speaker connector are damaged and part elements of the speaker connector cannot be reused any more, materials are wasted.

SUMMARY OF THE INVENTION

Accordingly, an object of the present invention is to provide a speaker connector used in an electronic device for connecting a speaker with a printed circuit board of the electronic device.

To achieve the above object, the speaker connector includes an insulating housing and a terminal. The insulating housing defines a holding groove extending therethrough. The terminal has a retaining portion retained in the holding groove of the insulating housing. A first resilient portion is connected to an upper end of the retaining portion and extends out of the holding groove. A first contact portion extends sideward from the first resilient portion for connecting the speaker. A second resilient portion with a zigzag configuration is connected to a lower end of the retaining portion and contained in the holding groove. A second contact portion is connected to a lower end of the second resilient portion and extends out of the holding groove for elastically touching the printed circuit board.

As described above, the speaker connector utilizes the elastic force of the terminal to make the first contact portion connect with the speaker and the second contact portion firmly and elastically touch the printed circuit board for attaining stable communication between the speaker and the printed circuit board. Therefore, the speaker connector connects the speaker and the printed circuit board without soldering, which makes the speaker connector be disassembled apart from the printed circuit board of the electronic device easily, and secures the printed circuit board and the speaker connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
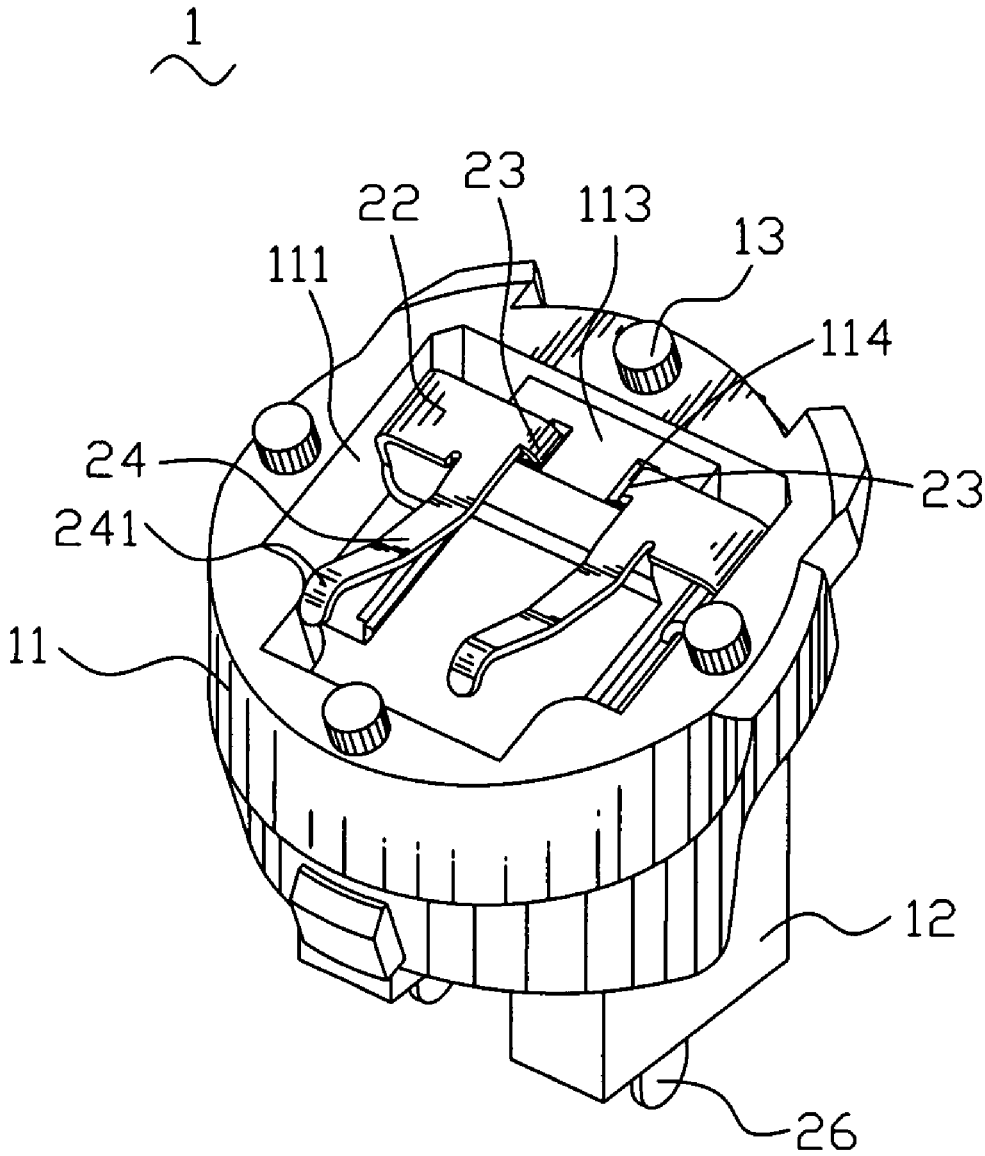
FIG. 1 is a perspective view of a speaker connector in accordance with the present invention.
Figure 2:
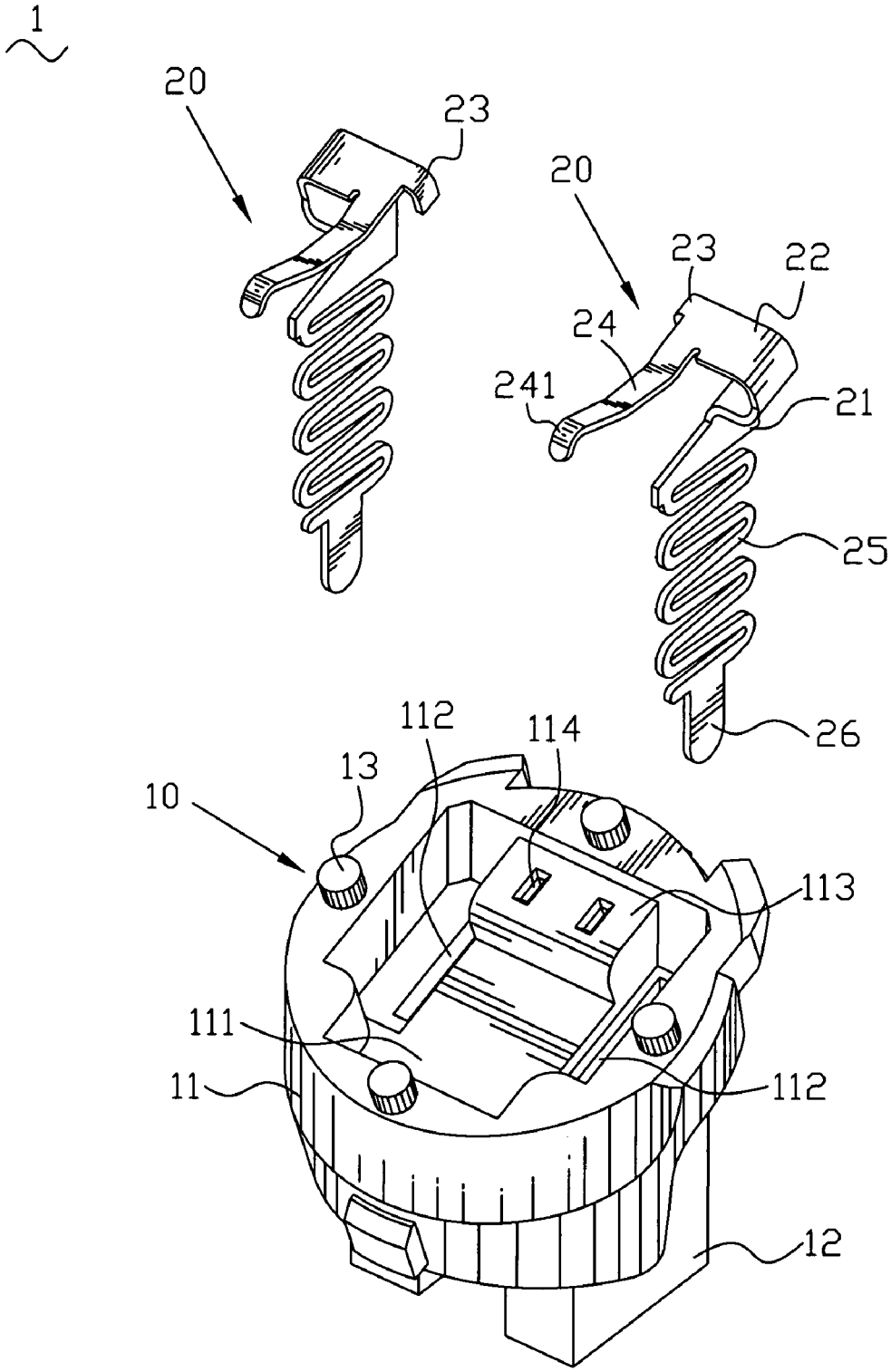
FIG. 2 is an exploded view of the speaker connector.

Referring to FIG. 1 and FIG. 2, a speaker connector 1 for connecting a speaker with a printed circuit board (PCB) of an electronic device of the present invention is illustrated that includes an insulating housing 10 and a pair of terminals 20 received in the insulating housing 10. For better understanding the present invention, the speaker connector 1 will be described in detail hereinafter.

Figure 4:
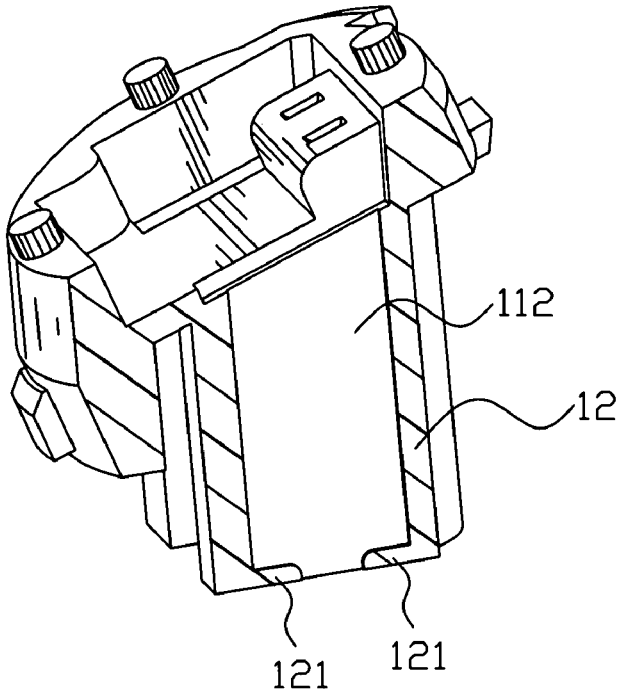
FIG. 4 is a cross-sectional view of an insulating housing of the speaker connector.

With reference to FIG. 2 and FIG. 4, the insulating housing 10 has a substantially column-shaped basic body 11. The bottom of the basic body 11 extends downward to form two parallel bulges 12 in rectangular strip-shape. The top of the basic body 11 is defined as an inclined plane. Four circular bulgy posts 13 stick out symmetrically from edges of the top of the basic body 11. The center of the top of the basic body 11 defines a receiving cavity 111 downward. Bilateral sides of the bottom of the receiving cavity 111 respectively define a holding groove 112 passing through the basic body 11 and extending through the bulge 12. The bottom of the receiving cavity 111 transversely protrudes upward to form a rectangular bump 113 between the two holding grooves 112. The top of the bump 113 longitudinally defines two parallel locating cavities 114 adjacent to the holding grooves 112 respectively. The bottom of the bulge 12 protrudes to form two shoulders 121 toward each other for partly sealing the holding groove 112.

Figure 3:
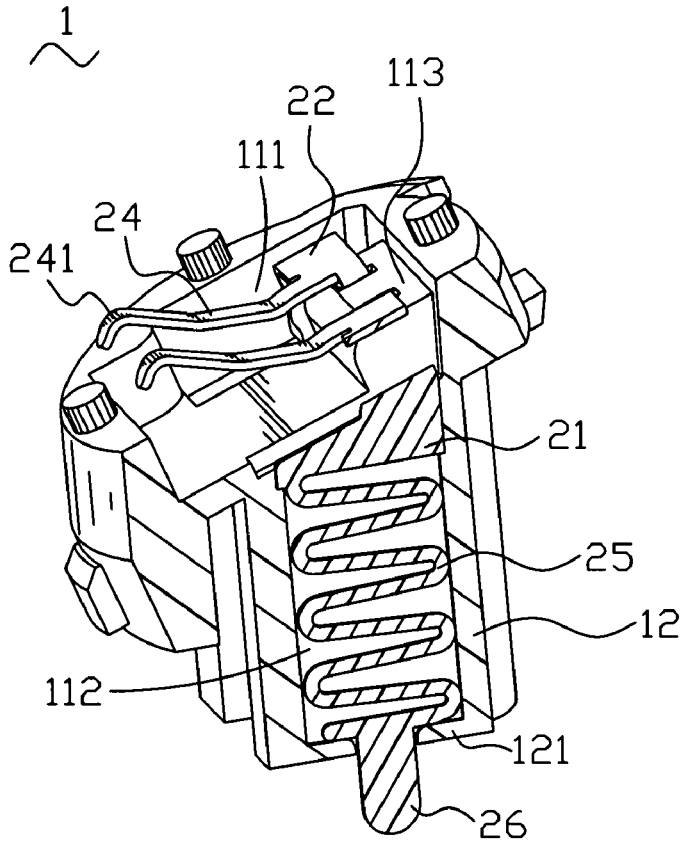
FIG. 3 is a cross-sectional view of the speaker connector.

Referring to FIG. 2 and FIG. 3, the terminal 20 has a board-shaped retaining portion 21 disposed vertically. The top of the retaining portion 21 extends sideward and then in an opposite direction to form a first resilient portion 22 in U-shape. A free end of the first resilient portion 22 stretches forward and bends downward to define a locking portion 23. A corner defined by the first resilient portion 22 and the locking portion 23 extends to form an elastic arm 24 perpendicular to the locking portion 23 and the first resilient portion 22. A free end of the elastic arm 24 tilts upward and then extends downward to form a first contact portion 241. The bottom of the retaining portion 21 extends and bends back and forth to form a second resilient portion 25 with a zigzag configuration. The bottom of the second resilient portion 25 extends downward to form a second contact portion 26 in sheet-shape and with a satiny free end at middle thereof.

Please refer to FIG. 1 and FIG. 3. In assembly, the retaining portion 21 and the second resilient portion 25 of the terminal 20 are retained in the holding groove 112 of the insulating housing 10. The bottom of the second resilient portion 25 is restricted in the holding groove 112 by the shoulders 121 defined at the bottom of the bulge 12. The second contact portion 26 stretches out of the holding groove 112 and is below the bulge 12. The bottom of the first resilient portion 22 is pressed against the bottom of the receiving cavity 111. The locking portion 23 is inserted in the locating cavity 114. The elastic arm 24 and the first contact portion 241 are above the receiving cavity 111. When the speaker connector 1 is in use, the speaker connector 1 is elastically blocked between the speaker and the PCB (not shown). The first contact portion 241 and the second contact portion 26 elastically touch the speaker and the PCB respectively for realizing an electrical connection between the speaker and the PCB of the electronic device.

As described above, the speaker connector 1 utilizes the elastic force of the terminals 20 to make the first contact portions 241 connect with the speaker and the second contact portions 26 firmly and elastically touch the PCB respectively for attaining stable communication between the speaker and the PCB. Comparatively, the speaker connector 1 connects the speaker and the PCB without soldering, which makes the speaker connector 1 be disassembled apart from the PCB of the electronic device easily, and at the same time secures the PCB and the speaker connector 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A speaker connector for connecting a speaker and a printed circuit board of an electronic device, comprising:

an insulating housing defining a holding groove extending therethrough, a top of the insulating housing defining a receiving cavity communicating with the holding groove, a bottom of the receiving cavity protruding upward to form a bump, the bump defining a locating cavity adjacent to the holding groove; and a terminal having a retaining portion retained in the holding groove of the insulating housing, a first resilient portion connected to an upper end of the retaining portion and extending out of the holding groove, a first contact portion extending sideward from the first resilient portion for connecting the speaker, a second resilient portion with a zigzag configuration connected to a lower end of the retaining portion and contained in the holding groove, and a second contact portion connected to a lower end of the second resilient portion and extending out of the holding groove for elastically touching the printed circuit board, the first resilient portion of the terminal being received in the receiving cavity, and the first contact portion of the terminal extending above the insulating housing, wherein the first resilient portion stretches forward and bends downward to define a locking portion inserted in the locating cavity.

2. The speaker connector as claimed in claim 1, wherein the insulating housing has a bulge protruding downward, the holding groove extends through the bulge and is sharply narrowed at a tail end thereof by a shoulder, the shoulder bends from a bottom of the bulge and appropriately extends towards the holding groove to restrict the second resilient portion of the terminal in the holding groove, and the second contact portion of the terminal extends below the bulge.

3. The speaker connector as claimed in claim 1, wherein the first resilient portion is formed by extending sideward from the upper end of the retaining portion and then in an opposite position.

4. The speaker connector as claimed in claim 1, wherein the terminal further has an elastic arm extending sideward from the first resilient portion, a free end of the elastic arm tilts upward and then downward to form the first contact portion.

* * * * *